US012473116B2

(12) United States Patent
Bhat et al.

(10) Patent No.: US 12,473,116 B2
(45) Date of Patent: Nov. 18, 2025

(54) MULTI-LAYER BOTTLE

(71) Applicant: PepsiCo, Inc., Purchase, NY (US)

(72) Inventors: Advait Bhat, White Plains, NY (US); Girish Deshpande, Carmel, NY (US); Brian Hershaft, Rye Brook, NY (US); David Mckelvey, Belfast (GB); Shiyong Yan, Belfast (GB)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 17/445,049

(22) Filed: Aug. 13, 2021

(65) Prior Publication Data

US 2023/0049435 A1 Feb. 16, 2023

(51) Int. Cl.

| | |
|---|---|
| ***B65D 1/02*** | (2006.01) |
| ***B65D 1/42*** | (2006.01) |
| ***B65D 23/02*** | (2006.01) |

(52) U.S. Cl.

CPC ..... *B65D 1/0215* (2013.01); *B65D 1/42* (2013.01); *B65D 23/02* (2013.01); *B65D 2205/02* (2013.01)

(58) Field of Classification Search

CPC ..... B65D 79/005; B65D 83/0055; B65D 1/0215; B65D 1/40; B65D 79/0084; B65D 81/3846; B65D 85/72

See application file for complete search history.

(56) References Cited

U.S. PATENT DOCUMENTS

| | | | | |
|---|---|---|---|---|
| 4,868,026 A * | 9/1989 | Shimizu | B65D 1/0215 264/537 |
| 5,344,045 A * | 9/1994 | Richter | B67D 1/0462 215/381 |
| 5,381,927 A | 1/1995 | Richter et al. | |
| 5,927,525 A | 7/1999 | Darr et al. | |
| 6,113,927 A * | 9/2000 | Hatakeyama | B65D 81/26 424/443 |

(Continued)

FOREIGN PATENT DOCUMENTS

| | | |
|---|---|---|
| WO | 2017164225 A1 | 9/2017 |
| WO | 2019093068 A1 | 5/2019 |

(Continued)

OTHER PUBLICATIONS

International Search Report and Written Opinion of the International Searching Authority directed to International Patent Application No. PCT/US2022/040210, mailed Dec. 19, 2022; 16 pages.

*Primary Examiner* — Andrew T Kirsch
(74) *Attorney, Agent, or Firm* — Sterne, Kessler, Goldstein & Fox P.L.L.C.

(57) ABSTRACT

A multi-layer beverage container includes a multi-layer wall having an outer layer, a middle layer, and an inner layer. At least the inner layer is configured to flex inwards to accommodate a change in the sealed internal volume of the beverage container after a hot-filled beverage is filled inside the container and allowed to cool. The outer layer and inner layer delaminate from each other to accommodate this volume change, which allows the outer layer to retain its original shape. The middle layer functions to encourage delamination of the layers with respect to each other. A space corresponding to the volume change of the interior volume of the container is formed between the wall layers.

19 Claims, 12 Drawing Sheets

(56) References Cited

U.S. PATENT DOCUMENTS

| | | | | |
|---|---|---|---|---|
| 8,607,999 | B2 * | 12/2013 | Toyoda | B29C 49/071 220/62.12 |
| 2003/0235667 | A1 | 12/2003 | Darr et al. | |
| 2005/0011892 | A1 | 1/2005 | Nakajima et al. | |
| 2007/0207190 | A1 | 9/2007 | Dierickx et al. | |
| 2013/0140264 | A1 | 6/2013 | Hanan | |
| 2015/0290645 | A1 * | 10/2015 | Hisano | B65D 51/16 422/509 |
| 2018/0016050 | A1 * | 1/2018 | Eguchi | B65D 1/0215 |
| 2020/0031552 | A1 | 1/2020 | Albaum | |
| 2021/0188474 | A1 * | 6/2021 | Suzuki | B65D 23/02 |

FOREIGN PATENT DOCUMENTS

| | | | |
|---|---|---|---|
| WO | 2019150702 | A1 | 8/2019 |
| WO | 2019163296 | A1 | 8/2019 |

* cited by examiner

MULTI-LAYER BOTTLE

FIELD

The described embodiments generally relate to beverage containers that are constructed from multiple layers of material.

BRIEF SUMMARY

An embodiment of a beverage bottle includes a layered wall, the layered wall having an outer layer, an inner layer, and an intermediate layer, where the outer layer and the inner layer are formed of the same material. The intermediate layer is a barrier layer and the outer layer is thicker than the inner layer.

An embodiment of a method of filling a hot beverage into a beverage bottle includes applying a negative pressure relative to ambient pressure to an interior of the beverage bottle before filling the beverage bottle to initiate delamination between an intermediate layer and an outer layer of the beverage bottle; filling the beverage bottle with a hot beverage; sealing the beverage bottle; and cooling the beverage such that the beverage reduces in volume, where the intermediate layer contracts to adapt to the reduced volume and the outer layer maintains its original shape.

An embodiment of a preform for a beverage bottle includes a layered wall, the layered wall having an outer layer, an inner layer, and an intermediate layer, where the outer layer and the inner layer are formed of the same material. The intermediate layer is a barrier layer and the outer layer is thicker than the inner layer.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION

Figure 1:
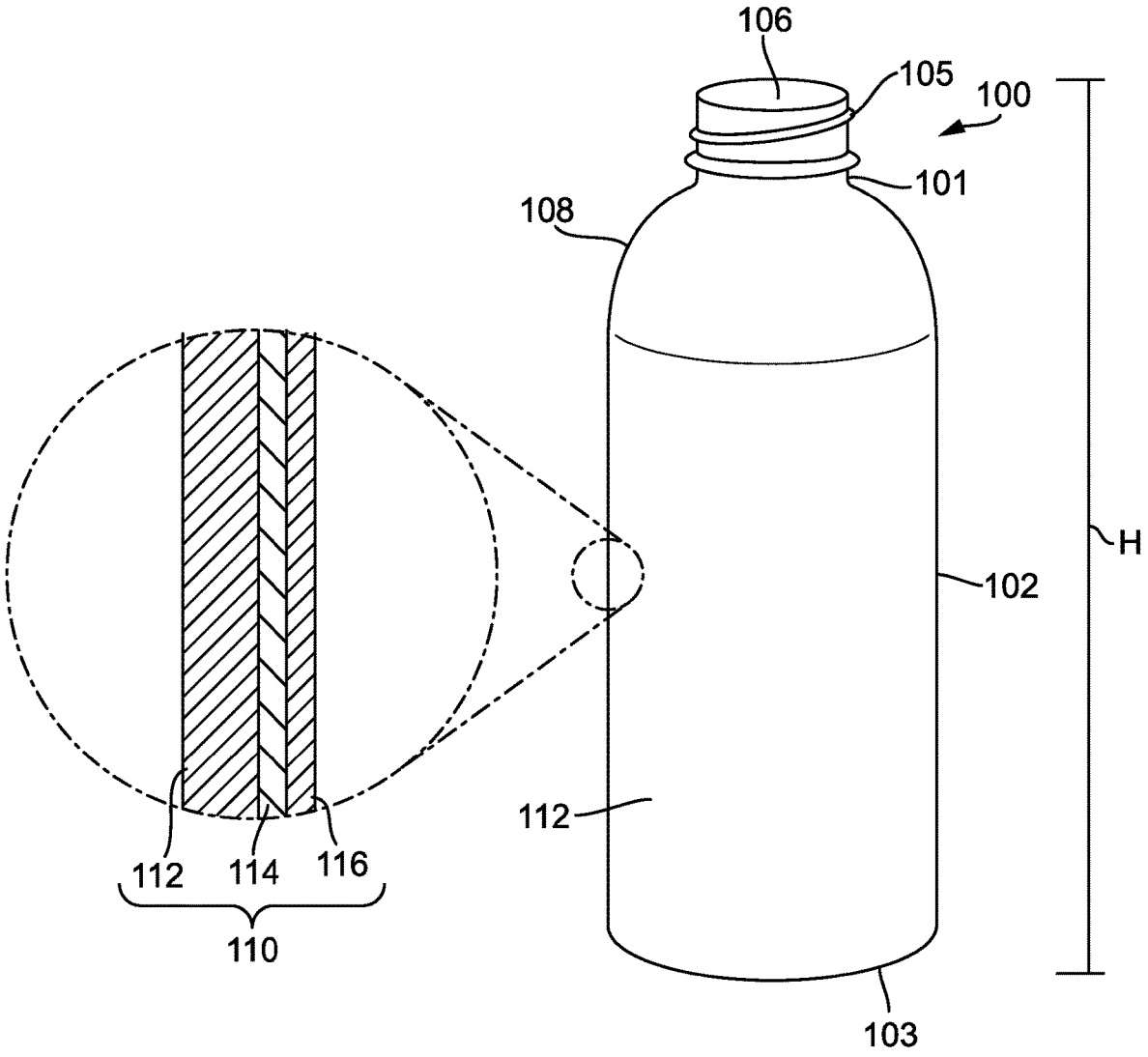
FIG. 1 is a front view of a beverage container according to an embodiment showing a wall structure of the beverage container.

The present invention(s) will now be described in detail with reference to embodiments thereof as illustrated in the accompanying drawings. References to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Plastic beverage containers, such as bottles, made from materials such as Polyethylene terephthalate ("PET") are widely used in the beverage industry to package beverages. PET bottles are a low-cost and lightweight alternative to bottles made from other plastic materials and materials such as glass or aluminum. Many beverages are filled into bottles at an elevated temperature. This practice, commonly known as "hot fill," is used to prevent contamination of beverages. This allows the beverage to be filled into a bottle without the need for additional sterilization. After the bottle is filled and capped, the beverage is allowed to cool from the elevated filling temperature. As the beverage cools it—along with correspondingly cooling air within the bottle—undergoes thermal contraction in volume.

Because the bottle is sealed while the beverage cools, the bottle must accommodate this contraction of volume of the trapped beverage and air. Designing a bottle with sufficient structural strength to withstand the resulting forces is possible, but this can require substantial additional material (i.e., wall thickness) and added cost, and may result in a significant negative pressure within the bottle. Thus, to accommodate this contraction of volume without using thickened walls, the walls of the bottle may deform so that the volume of the interior of the bottle reduces along with the reduction in volume of its contents.

Some bottles may be designed with movable walls and panels that are designed to flex inwardly to accommodate the interior reduction in volume attendant to thermal contraction of the bottle contents. However this can require unwanted interruptions and irregular surfaces in the visual and tactile embodiments of the bottle. Such surface structures can also make a bottle hard or awkward for a user to squeeze, which some users may want to do to facilitate drinking from the bottle (e.g., through a reclosable spout).

Embodiments described herein, however, accommodate a hot-filled bottle's interior reduction in volume caused by thermal contraction of the bottle contents without resisting the change in volume. The resulting bottle does not require exterior movable walls and panels, and does not change exterior shape due to the thermal contraction of the beverage. For example, a bottle can include a multi-layer wall construction, where one or more of the plastic inner layers of the bottle wall can move independently away from the plastic outer layer of the bottle wall to accommodate a change in internal volume of the bottle. In other words, there may be a space between the outer layer and the inner layer. And although the inner layer deforms, by shrinking or flexing, and pulls away from the outer layer so that the internal volume of the bottle changes, the outer layer maintains its shape. Therefore the outer shape of the bottle remains constant throughout the thermal contraction of its contents, while the inner layer shrinks or flexes to accommodate the thermal contraction. This contraction of the inner layer also reduces undesirable negative pressure formed formation inside the sealed bottle.

Embodiments described herein may facilitate separation of inner and outer layers of a bottle so that the inner layer can accommodate the reduction in volume while the outer layer can retain its shape and structural integrity (e.g., ability to withstand top loads). For example, the inner layer can be thinner than the outer layer, so that the inner layer is more capable of deforming while the outer layer resists such deformation, causing the inner layer to separate and peel away from the outer layer. Some embodiments may include air inlet holes through the outer layer but not the inner layer to allow air to enter between the layers and further facilitate their separation. Also, in some embodiments a negative pressure can be applied within the bottle before filling, to pre-pull the inner layer away from the outer layer, thus making it easier to separate later due to thermal contraction.

Figure 2:
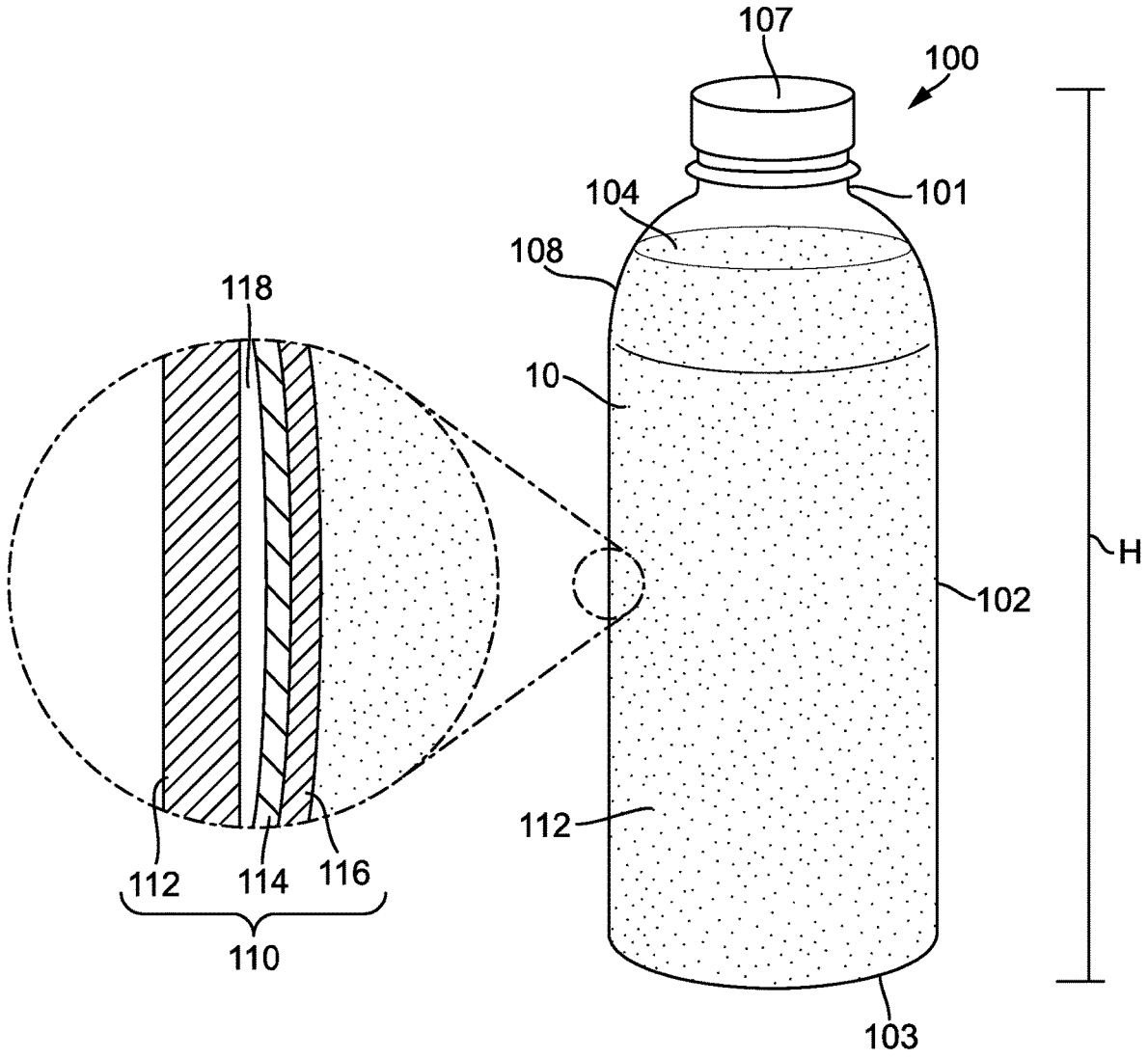
FIG. 2 is a front view of a beverage container in a filled configuration according to an embodiment showing a wall structure of the beverage container.

FIGS. 1 and 2 show a beverage container (bottle 100) before filling (FIG. 1) and after a hot-fill filling, capping, and cooling process (FIG. 2). Bottle 100 can include a body 102 with a neck 101 and a base 103. In some embodiments, body 102 is cylindrical. Body 102 narrows to meet neck 101 at a shoulder 108. Neck 101 has an opening 106 and, as shown in FIG. 1, may have threads 105 disposed on an exterior of neck 101. As shown in FIG. 2, bottle 100 may be closed by a cap 107 that is threaded on threads 105 on neck 101 to close opening 106. The closure of opening 106 by cap 107 can be air-tight through the use of appropriate sealing elements disposed in cap 107. Base 103 is disposed opposite of neck 101 on body 102 and closes the other end of body 102, thereby forming a sealed bottle 100 when cap 107 is present on neck 101.

FIGS. 1 and 2 include a cross-sectional inset showing a portion of bottle 100's multi-layer wall 110, which includes outer layer 112, middle or intermediate layer 114 and inner layer 116. Outer layer 112 is the outermost layer of multi-layer wall 110 and forms the outer surface of multi-layer wall 110. Middle layer 114 is disposed inside of outer layer 112, and inner layer 116 is disposed inside of middle layer 114. Middle layer 114 separates inner layer 116 from outer layer 112. As shown in FIG. 1, both middle layer 114 and inner layer 116 follow the shape of outer layer 112 before the filling process begins. As explained in detail below, these layers are molded together to form multi-layer wall 110 as a single, integrated structure. In some embodiments, bottle 100 is formed through blow molding a single preform 200 that includes multi-layer wall 110 (including all of its layers).

In some embodiments, multi-layer wall 110 has only three layers as shown in FIGS. 1 and 2. This minimizes the number of layers, and thus reduces manufacturing complexity, but still allows these embodiments of bottle 100 to achieve the benefits discussed below. In some embodiments, there may be more than three layers of multi-layer wall 110. In these embodiments, the number of layers of multi-layer wall 110 may be any desired odd number. For example, embodiments of multi-layer wall 110 may include 3, 5, or 7 different layers. In the embodiments of multi-layer wall 110 with more than three layers as shown in FIGS. 1 and 2, additional intermediate layers 114 can be present, but there will always be a single outer layer 112. Intermediate layer 114 will be referred to as middle layer 114 below when discussing a three multi-layer wall 110.

Figure 4:
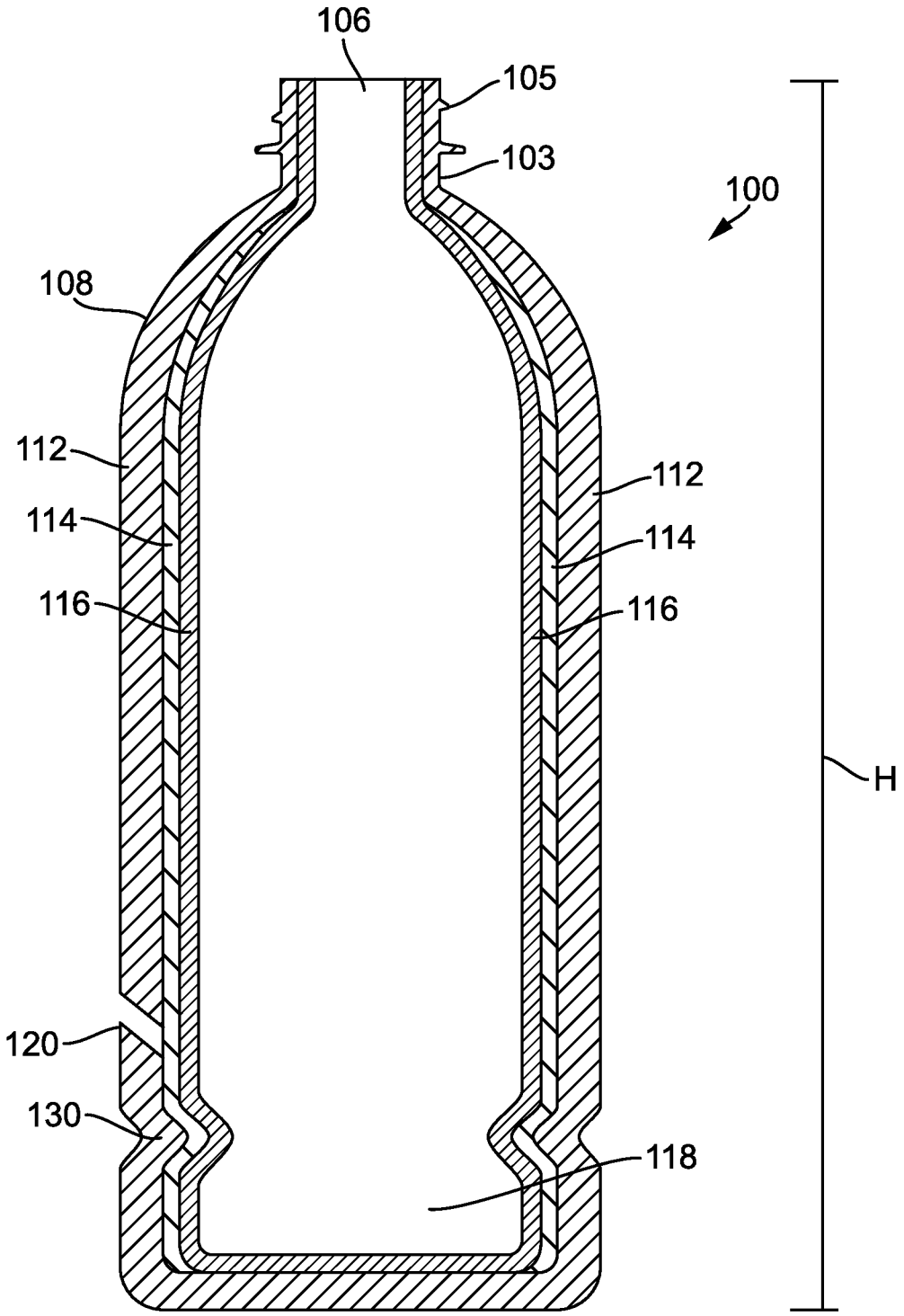
FIG. 4 is a cross section view of the beverage container of FIG. 1.

In some embodiments, middle layer 114 multi-layer wall 110 discussed above does not extend into a neck finish of bottle 100 or into base 103 of bottle 100. In other words, middle layer 114 is disposed between the neck finish and base 103. For example, middle layer 114 may extend the height of bottle 100 from base 103 to neck 101. Middle layer 114 of multi-layer wall 110 may only extend along a portion of a height H of bottle 100. For example, middle layer 114 of multi-layer wall 110 may extend from base 103 and may stop at shoulder 108. As shown in FIG. 4, for example, middle layer 114 of multi-layer wall 110 may stop between 0.01H and 0.1H below opening 106. In these embodiments, the remainder of neck 101 can be constructed from multi-layer wall 110 having an outer layer 112 and an inner layer 116. Where outer layer 112 and inner layer 116 are not separated by middle layer 114 (e.g., in neck 101 and base 103) they may merge to form a single layer in embodiments where outer layer 112 and inner layer 116 are formed of the same material. In some of these embodiments, middle layer 114 of multi-layer wall 110 does not extend into base 103. Limiting the construction of multi-layer wall 110 in this way can improve recyclability of bottle 100 because it is easier to remove middle layer 114 from these embodiments of bottle 100 during recycling. This feature is useful when middle layer 114 is formed from different material from outer layer 112 and inner layer 116 because this allows for different recycling processes to be used on these different materials.

In some embodiments of multi-layer wall 110, outer layer 112 is thicker than either middle layer 114 or inner layer 116. This additional thickness allows outer layer 112 to provide most or substantially all of the structural support needed to ensure adequate structural integrity of bottle 100 (e.g., strength in the axial bottle's axial direction, which may be referred to as top-load strength). For example, in embodiments of bottle 100 where outer layer 112 is thicker as discussed here, middle layer 114 and inner layer 116 may provide minimal or no contribution to the structural integrity of bottle 100.

Figure 3:
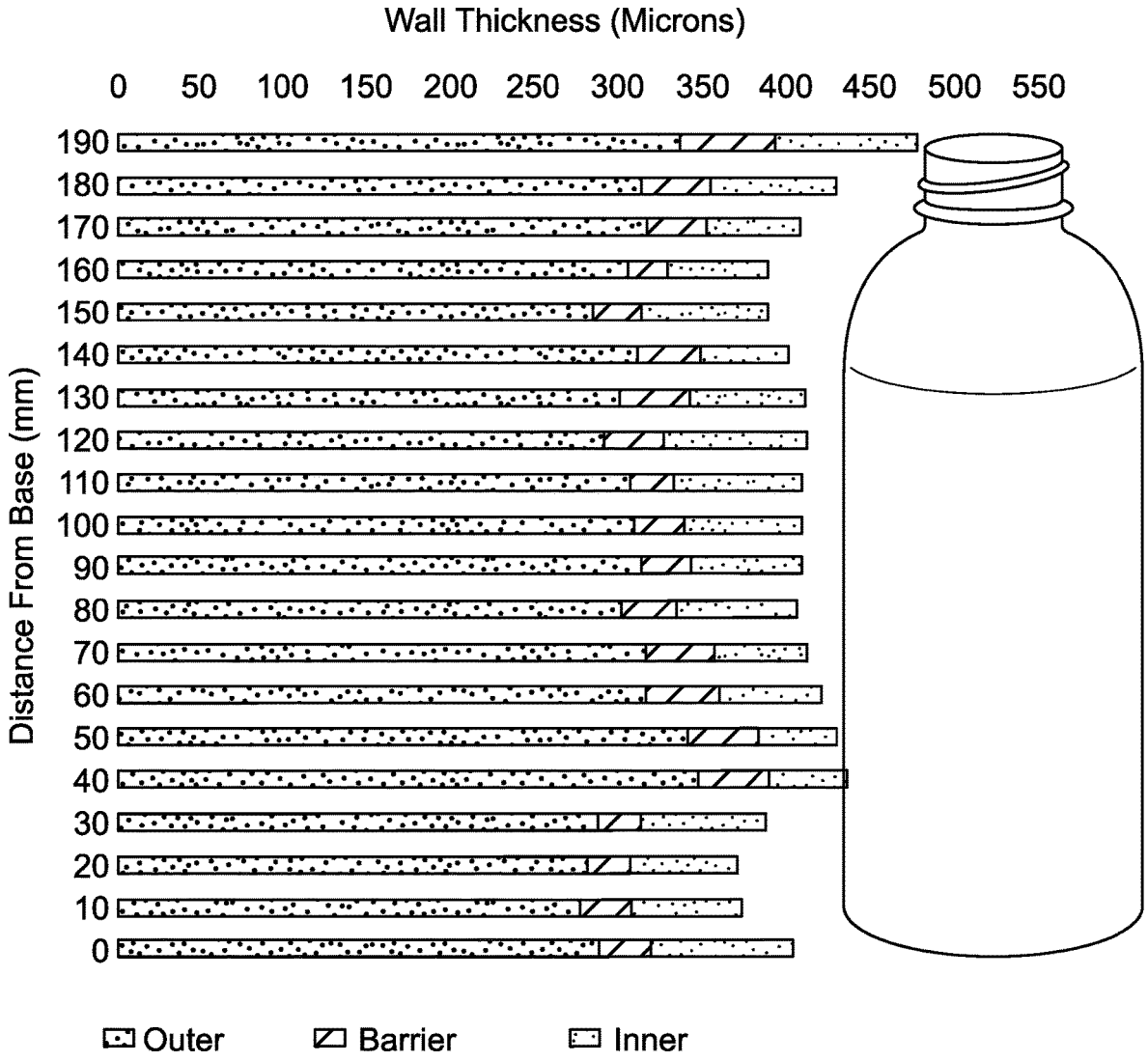
FIG. 3 is a thickness plot of a wall section of a beverage container according to an embodiment.

As shown in FIG. 3, in some embodiments, outer layer 112 may be between two and five times thicker than inner layer 116. That is, the average thickness of outer layer 112 may be between two and five times thicker than the average thickness of inner layer 116. This difference in thickness may extend for the majority of the height of the bottle. For example, in some embodiments from base 103 to neck 101, or in some embodiments at least 80% of the distance between base 103 and neck 101. At the same time, middle layer 114 may be between 0.25 and 0.9 times the thickness of inner layer 116. That is, the average thickness of middle layer 114 may be between 0.25 and 0.9 times the average thickness of inner layer 116 over the coverage of middle layer 114. In some embodiments, outer layer 112 is four times thicker than inner layer 116. In some embodiments, outer layer 112 is three times thicker than inner layer 116.

In some embodiments of multi-layer wall 110, the thicknesses of outer layer 112, middle layer 114, and inner layer 116 are constant, within a suitable manufacturing tolerance such as plus or minus 10% thickness, throughout the extent of multi-layer wall 110. In other embodiments, the thickness of outer layer 112, middle layer 114, and inner layer 116 can vary at different locations along height H of bottle 100. An example of a plot of thicknesses of outer layer 112, middle layer 114, and inner layer 116 varying by height is shown in FIG. 3. As seen in FIG. 3, while the thicknesses of the layers vary slightly along the height of bottle 100, both relative to each other (e.g., comparing outer layer 112 to inner layer 116) and in absolute terms, the thickness of outer layer 112 remains several times thicker than the thickness of inner layer 116.

Outer layer 112, middle layer 114, and inner layer 116 may be made from plastic materials. Suitable materials may include PET, nylon, polyglycolic acid ("PGA") and high-density polyethylene ("HDPE"). In some embodiments, outer layer 112 and inner layer 116 may be made from the same material, while middle layer 114 may be made from a different material. In some embodiments, the material of middle layer 114 may be a gas barrier material such as nylon or HDPE. In some embodiments, the material of middle layer 114 may be selected because it has a relatively lower adhesion to the materials of outer layer 112 and inner layer 116 when compared to the adhesion of the materials of outer layer 112 and inner layer 116. For example, outer layer 112 and inner layer 116 may be made from PET and middle layer 114 may be made from nylon. The nylon may be Nylon-MXD6, for example. In some embodiments, the materials selected for outer layer 112, middle layer 114, and inner layer 116 can be substantially transparent or clear. In other embodiments, the materials selected for outer layer 112, middle layer 114, and inner layer 116 can be colored or tinted through the use of suitable additives, and can therefore be opaque (i.e., the materials do not allow light transmission). In some embodiments, additives may be added to any of the materials discussed above to modify the material properties of outer layer 112, middle layer 114, and inner layer 116. Specifically, additives that effect the adhesion of outer layer 112, middle layer 114, and inner layer 116 (e.g., slip additives) can be added to control delamination as desired.

As shown in FIG. 1, before bottle 100 is filled, outer layer 112, middle layer 114, and inner layer 116 are layered together and are in contact with each other. As shown in FIG. 2, after bottle 100 is filled with a hot beverage 10, opening 106 is capped with cap 107. As beverage 10 cools, both it and any remaining air trapped in bottle 100 undergoes thermal contraction. Due to cap 107, no new matter may be introduced into an interior volume 104 defined by inner layer 116, and thus interior volume 104 contracts along with beverage 10. In doing so, middle layer 114 and inner layer 116 pull away from outer layer 112, creating a space 118 between (1) middle layer 114 and inner layer 116 together and (2) outer layer 112 while inner layer 116 remains sealed. This allows middle layer 114 and inner layer 116 to deform inwardly to accommodate the volume reduction within interior volume 104, while outer layer 112 remains undeformed and its structural integrity maintained.

In some embodiments as shown in FIG. 2, space 118 is formed between middle layer 114 and outer layer 112, and therefore there is no space formed between middle layer 114 and inner layer 116. The volume change of interior volume 104 after cooling has been determined to be between 1% and 5% of the initial interior volume 104. After cooling of beverage 10, the volume of space 118 is equal to the volume change, and thus ranges between 1% and 5% of the initial interior volume 104. This helps result in the internal pressure of interior volume 104 being close to or approximately equal to ambient pressure, which reduces difficulty when opening a sealed bottle 100. For example, the interior pressure of interior volume 104 after delamination is complete can range between 14.0 pounds per square inches absolute ("psia") and 14.7 psia. In some aspects, the final interior pressure of interior volume 104 is 14.4 psia.

This intentional separation or delamination of middle layer 114 and inner layer 116 from outer layer 112 allows bottle 100 to adapt to the volume change of beverage 10 without requiring contraction or flexing from outer layer 112. This allows outer layer 112 to have a smooth exterior surface because it does not need to be designed with structural features such as ribs, panels, or other features to adapt to or resist the volume change. The smooth exterior surface of outer layer 112 improves the visual and tactile experience of a user drinking from bottle 100. Another benefit of the above embodiments is that resulting bottle 100 is "squeezable" by a consumer, and the aesthetics and feeling of bottle 100 in the hand of a consumer during squeezing is improved when compared to those of ordinary plastic bottles that may be squeezed. This is because the same ribs, panels, and other structure that are used to inhibit or control deformation in some plastic hot-fill bottles also tend to resist deformation from squeezing, making a bottle hard and awkward for a user to squeeze, often result in in a cracking or crinkling sound and feeling during squeezing. Embodiments of bottle 100 as described here have a smooth exterior and will have minimal or no cracking and crinkling and lower resistance to squeezing. Another benefit of a smooth exterior surface of outer layer 112 is enhanced label performance and appearance. The smooth exterior surface makes it easier for labels to be applied and also improves their final appearance.

Controlling the delamination of the layers of multi-layer wall 110 to ensure an even distribution of space 118 around bottle 100 can also provide aesthetic benefit. In some embodiments, the material of middle layer 114 is different than that of outer layer 112 and inner layer 116. This different material of middle layer 114 can be selected because it has low adhesion to the materials of outer layer 112 and inner layer 116. This improves delamination because the layers separate or delaminate more easily than if they were made of material that adheres together well. In some embodiments, outer layer 112 and inner layer 116 may be made from the same material, for example, PET. In these embodiments, middle layer 114 may be made from a nylon material, which has relatively low adhesion with PET. This improves delamination of the layers of multi-layer wall 110. In some embodiments, middle layer 114 may also be formed from a material that functions as a gas barrier, which means that middle layer 114 inhibits gasses to pass through it. This inhibits gasses, including gasses such as oxygen from the ambient atmosphere outside of bottle 100, from reaching beverage 10, which reduces spoilage of beverage 10. In some embodiments, the outer layer 112, middle layer 114, and inner layer 116 may also include additives or surface treatments that decrease adhesion between the layers to further promote delamination.

The relative thicknesses of outer layer 112, middle layer 114, and inner layer 116 can also affect delamination of the layers. As discussed above, in some embodiments outer layer 112 may be between 2 and 5 times thicker than inner layer 116, which is in turn thicker than middle layer 114. Thus, outer layer 112 is much more rigid than middle layer 114 and inner layer 116 and resists flexing inwards when negative pressure exists in interior volume 104. Because middle layer 114 and inner layer 116 are much thinner than outer layer 112, these layers deform and flex inwards more easily than outer layer 112, and thus delaminate from outer layer 112. This is especially the case when plastics with relatively similar material strength are used for outer layer 112, middle layer 114, and inner layer 116 because the reduced wall thickness will correspond more directly to the layer's resistance to deformation.

As shown in FIG. 3, the relative thicknesses of outer layer 112, middle layer 114, and inner layer 116 can also be varied to increase or decrease delamination in different areas of bottle 100. Delamination is increased when outer layer 112 is relatively thicker than middle layer 114 and inner layer 116 because outer layer 112 flexes less with respect to middle layer 114 and inner layer 116. The reduced relative flexing increases the forces that separate middle layer 114 and inner layer 116 from outer layer 112 and thus increase delamination. Conversely, delamination is decreased when outer layer 112 is made thinner because outer layer 112 will flex more with respect to middle layer 114 and inner layer 116. This effect can be used to affect delamination throughout bottle 100. For example, if testing shows that a portion of multi-layer wall 110 is not delaminating evenly because of a structural feature like a curve in multi-layer wall 110, outer layer 112 can be made thicker relative to middle layer 114 and inner layer 116 in this specific portion to improve delamination.

In some embodiments as shown, for example, in FIG. 4, bottle 100 may include a stress concentrator 130 that is a structural feature that acts to concentrate the stress on the layers caused by the negative pressure of the cooling beverage. Concentrating stress in a specific area can help initiate delamination and thus improves delamination performance of bottle 100. As shown in FIG. 4, stress concentrator 130 can be a circumferential indentation or inwards turn of multi-layer wall 110. In the embodiment of FIG. 4, stress concentrator 130 is a sharp, triangular-shaped indentation of multi-layer wall 110. The relatively sharp point of this embodiment of stress concentrator 130 helps concentrate stress at the innermost point of stress concentrator 130, which can improve delamination. Other embodiments of stress concentrator 130 can be formed with rectangular or circular cross-sectional shapes. In some embodiments, stress concentrator 130 is formed near base 103 because delamination stresses are naturally higher near base 103 due to the curvature of bottle 100. Placing stress concentrator 130 near base 103 can also reduce the visual impact of stress concentrator 130.

Figure 5:
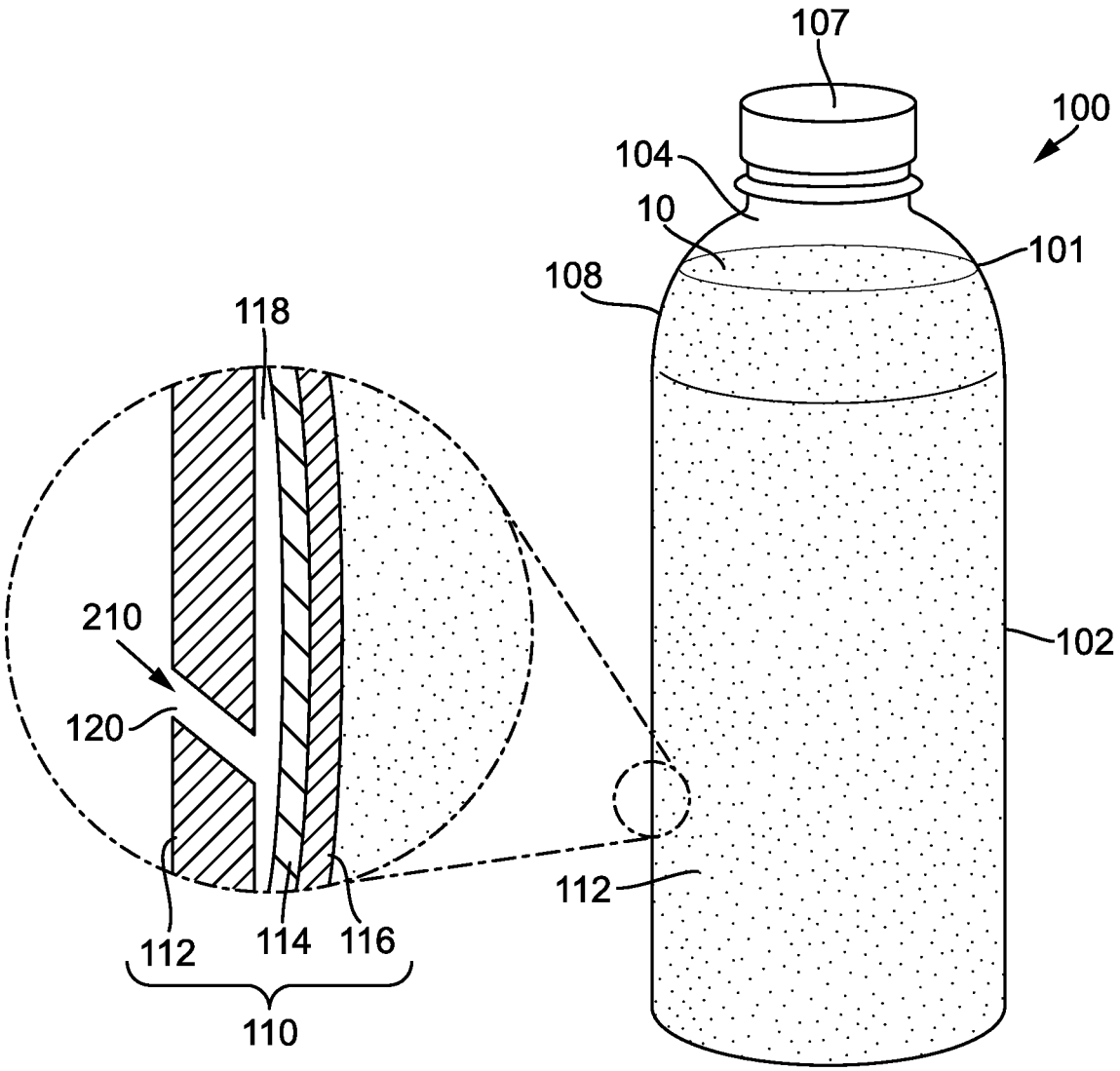
FIG. 5 is a front view of a beverage container according to an embodiment showing a wall structure of the beverage container.

As discussed above, space 118 is formed by the delamination of multi-layer wall 110 to compensate for the reduction in interior volume 104 caused by the cooling beverage 10. Space 118 is able to equalize with ambient atmospheric pressure through a vent hole 120 through outer layer 112. As shown in FIG. 5, vent hole 120 passes through outer layer 112 but does not pass through middle layer 114 or inner layer 116. Space 118 is able to equalize with the ambient atmosphere by air ingress through vent hole 120 as inner layer 116 and middle layer 114 pull away from outer layer 112. This equalization improves delamination by allowing space 118 to form more readily by allowing ambient atmosphere to flow into space 118. Vent hole 120 can be disposed in any position on bottle 100. In some embodiments, vent hole 120 can be positioned where it can be covered with a label after beverage 10 has cooled and delamination of multi-layer wall 110 is completed. This can reduce visual distraction caused by vent hole 120. In some embodiments, vent hole 120 can be positioned in the lower one-third of bottle 100, which is the one-third of bottle 100 that is closest to base 103. In some embodiments, vent hole 120 can be placed adjacent to stress concentrator 130 to further improve delamination performance by improving pressure equalization of space 118 that is formed at stress concentrator 130. Vent hole 120 being adjacent stress concentrator 130 can help propagate delamination once delamination is initiated at stress concentrator 130. For example, middle layer 114 and inner layer 116 may initially delaminate at stress concentrator 130, and as that delamination reaches vent hole 120 the area between outer layer 112 and middle layer 114 will be opened to the atmosphere, allowing air to vent into the space between outer layer 112 and middle layer 114, thereby promoting further propagation of the delamination.

In some embodiments, vent hole 120 is circular. In some embodiments, vent hole 120 is elliptical. In either of these embodiments, vent hole 120 can have a diameter or major and minor axes (i.e., a minimum opening dimension) that is/are greater than or equal to 2 millimeters.

In some embodiments there can be more than one vent hole 120 disposed in outer layer 112. The plurality of vent holes 120 may be spaced equally about the circumference of bottle 100. Each vent hole 120 can be at the same distance from base 103, or may be positioned at a different distances form base 103.

Figure 6:
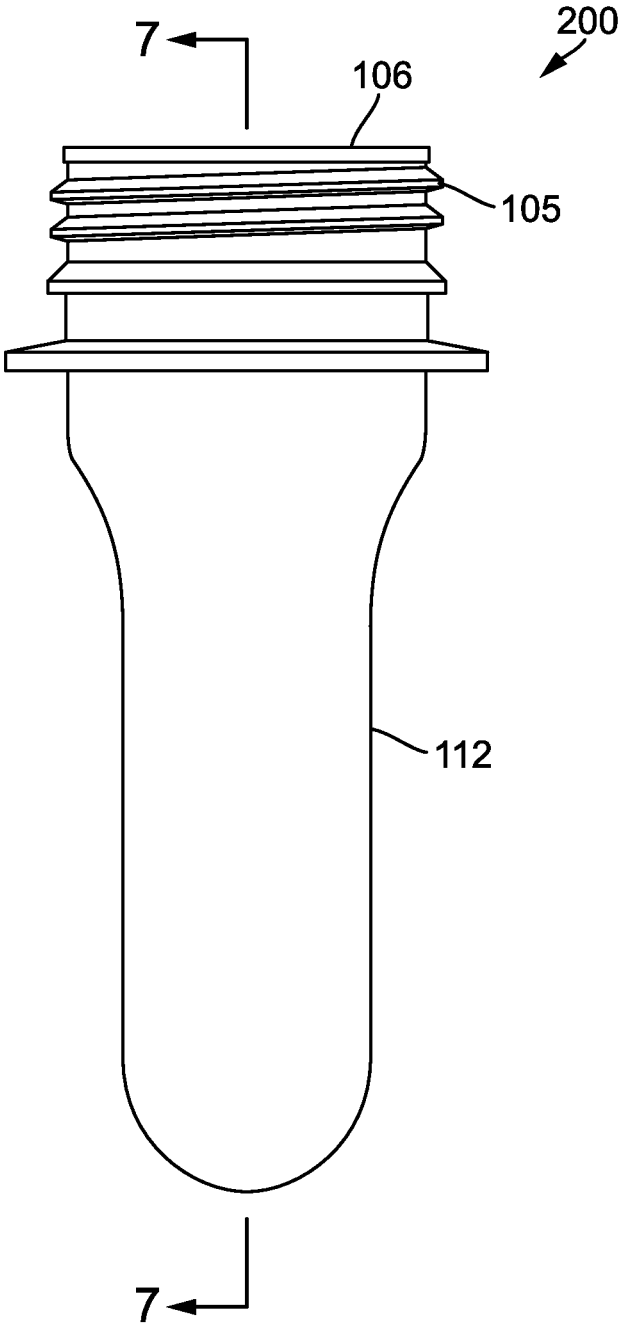
FIG. 6 is a front view of a preform for a beverage container according to an embodiment.
Figure 7:
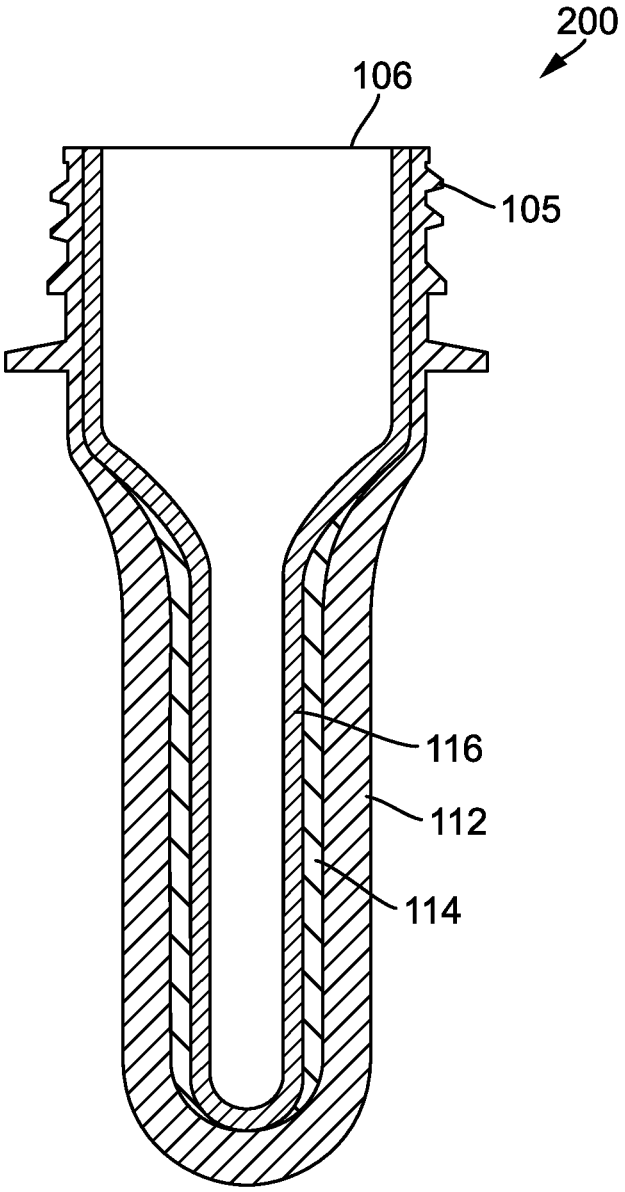
FIG. 7 is a cross section of the preform of FIG. 6.

Embodiments of bottle 100 discussed above may be manufactured using a bottle preform as will be explained below. FIG. 6 shows a preform 200 that can be used to manufacture bottle 100. As seen in the cross-section of FIG. 7, preform 200 includes multi-layer wall 110 with outer layer 112, middle layer 114, and inner layer 116 as discussed above. The various features of multi-layer wall 110 discussed above, including the relative layer thicknesses, layer materials, and layer construction apply equally to preform 200. However, the actual ratios of the thicknesses of the outer layer 112, middle layer 114, and inner layer 116 may be different than the final ratios of bottle 100 because of wall thickness changes caused by the blowing process discussed below. For example, in some embodiments, the ratio of the thickness of outer layer 112 to inner layer 116 may be between 2:1 and 5:1. The ratio of the thickness of middle layer 114 to inner layer 116 may be between 0.1:1 and 0.35:1. The layers of preform 200 may also be physically biased towards or away from each other to improve formation of multi-layer wall 110 in bottle 100.

Embodiments of preform 200 may be manufactured using several different methods. In a single preform method, the plastic material of outer layer 112, middle layer 114, and inner layer 116 are simultaneously injected into a preform mold. In a multi-stage preform method, outer layer 112, middle layer 114, and inner layer 116 are manufactured using separate preform molds. For example, outer layer 112 can be manufactured in a first molding step, and middle layer 114 and inner layer 116 can be manufactured in a separate molding step. Middle layer 114 and inner layer 116 are then inserted into outer layer 112 to form preform 200.

Bottle 100 is formed from preform 200 by inserting preform 200 into a female mold of the proper shape, stretching preform 200 and blowing heated air into preform 200 to form bottle 100 against the mold. It was discovered that changing the axial length L of preform 200 can be used to further control delamination of multi-layer wall 110. Embodiments of preform 200 with a greater axial length L that need to expand less in the axial direction to form bottle 100 result in easier delamination of multi-layer wall 110. The converse is true for embodiments of preform 200 that have a shorter axial length L. Thus, the selection of axial length L of can also be used to affect delamination of multi-layer wall 110. This effect is caused because preform 200 with a greater axial length L has less stress induced during the blowing process in the resulting multi-layer wall 110, which results in easier delamination. Preform 200 with a shorter axial length L has a greater stresses induced, and thus less efficient delamination of multi-layer wall 110.

After expansion of preform 200 into bottle 100, vent holes 120 are formed in outer layer 112. In some embodiments, vent holes 120 are formed by applying a suitable laser drill to outer layer 112 to melt vent hole 120 into outer layer 112. In some embodiments of this manufacturing method the angle of a beam 210 of the laser drill may be perpendicular to outer layer 112 (i.e., beam 210 is horizontal toward outer layer when outer layer 112 is vertical). Beam 210 may also contact outer layer 112 at any desired non-perpendicular angle. In some embodiments, beam 210 may form an angle between perpendicular and forty-five degrees upwards or downwards from perpendicular with outer layer 112, as shown in FIG. 5. Angling beam 210 upwards as shown in FIG. 5 allows the melted material of outer layer 112 to more easily drain clear of vent hole 120, which improves production efficiency and quality by improving the success rate of this forming step by minimizing clogging of vent hole 120 with re-solidified material. In some embodiments, the melted material can also be cleared from vent hole 120 by applying heat to the hole area (e.g., by using a heat gun) or by the use of chemical etchants applied after the hole is formed. These techniques can be used instead of or in addition to the angled technique discussed above. Other embodiments of forming vent holes 120 can be accomplished using a standard drill to create vent holes 120 in outer layer 112.

Figure 8A:
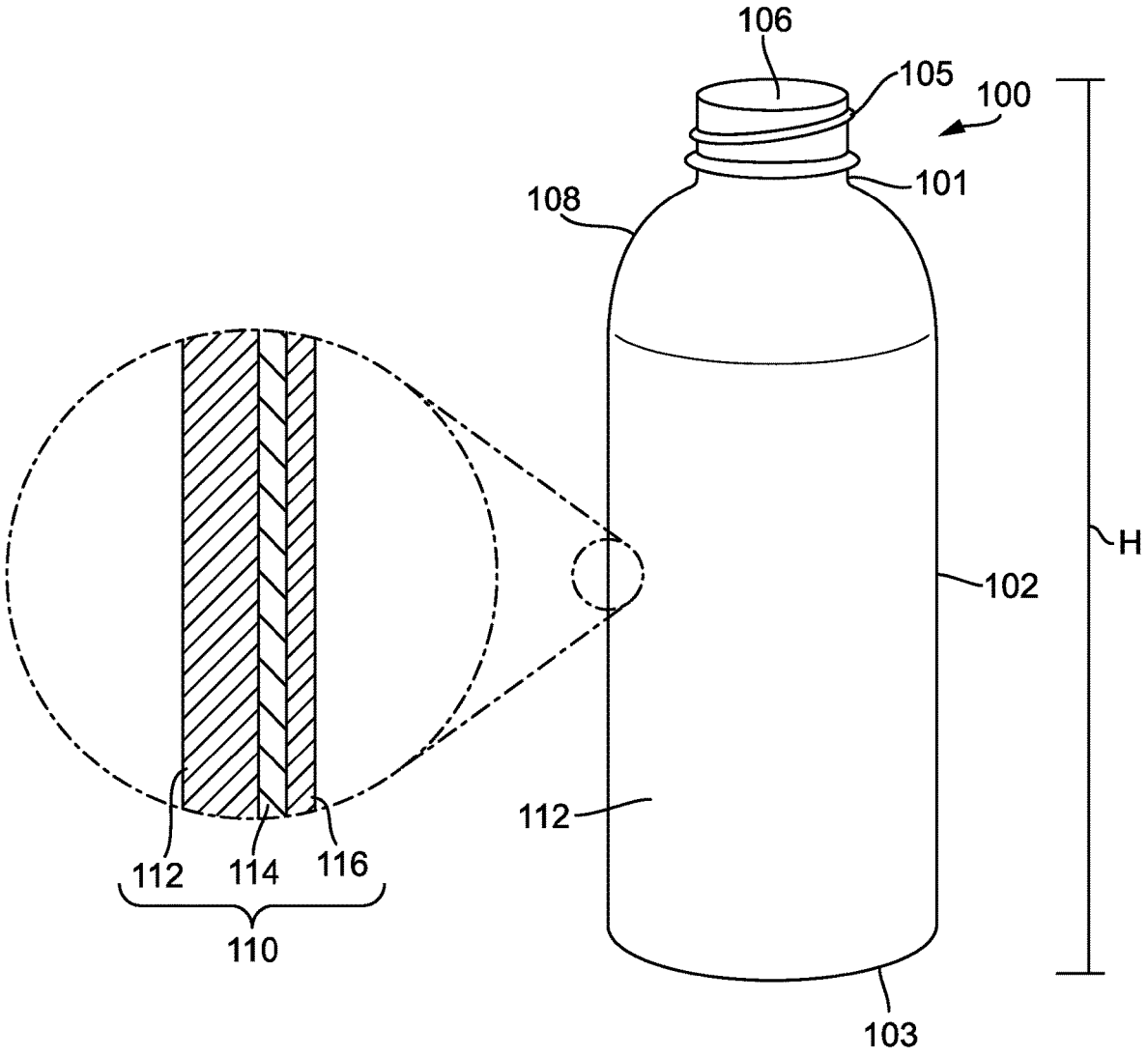
FIGS. 8A-8E are front views of a beverage container during a filling process according to an embodiment.
Figure 8B:
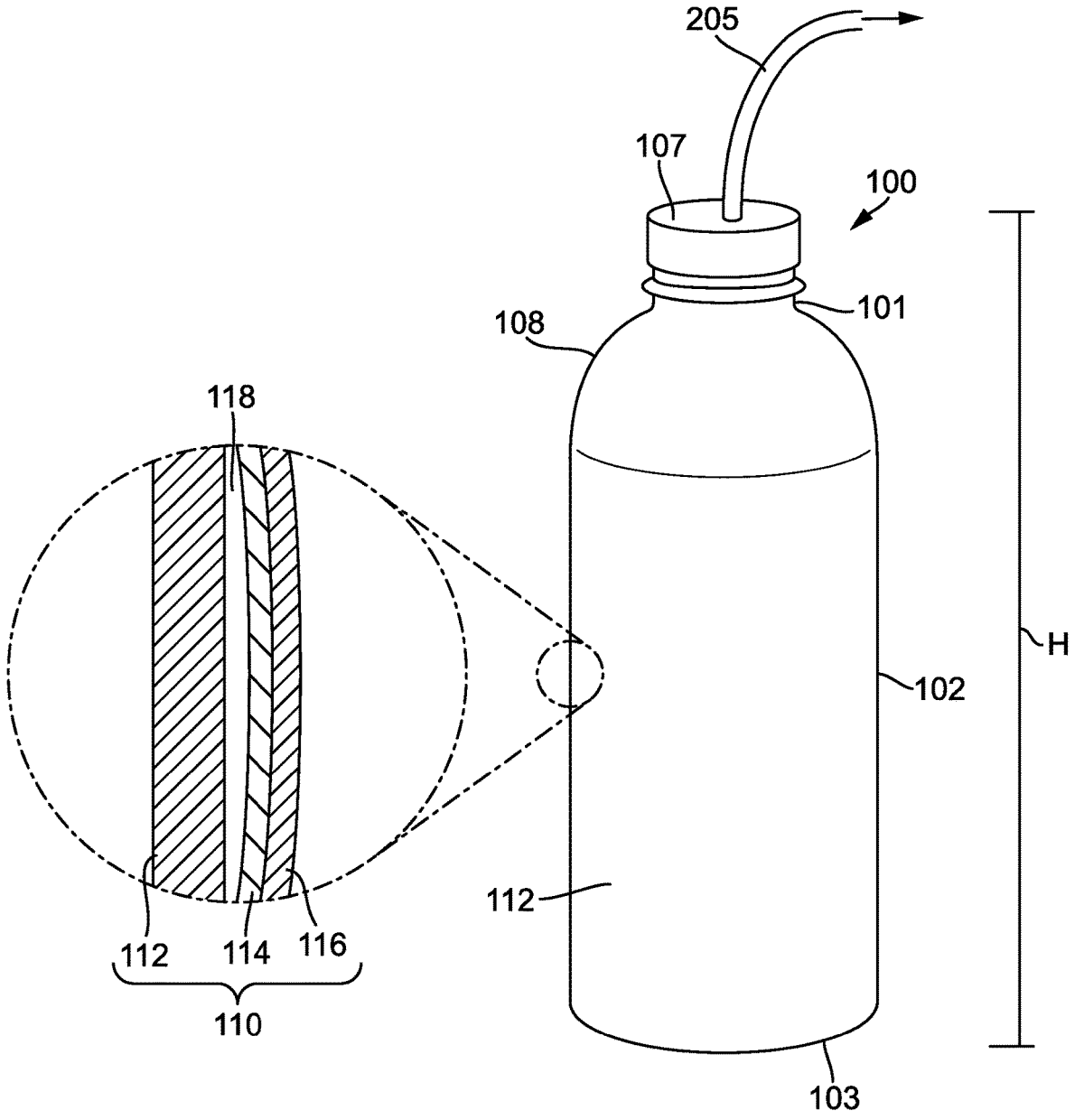

A method of filling bottle 100 will be discussed with reference to FIGS. 8A-8E. FIG. 8A shows a bottle 100 ready for filling with hot beverage 10. The steps of this method may all be performed on a bottling line using bottling equipment. Bottle 100 may be constructed according any embodiments discussed above and includes a multi-layer wall 110 as shown in the cross-section inset. Prior to filling bottle 100 with hot beverage 10, other methods of controlling delamination may be applied to bottle 100. For example, manual initiation of delamination by physically separating the layers of multi-layer wall 110 can be used to improve delamination of bottle 100 during filling by reducing the forces required for delamination. An example of manual initiation of delamination can be impacting outer layer 112 with a sharp force prior to filling. The shock and deflection caused by the impact to outer layer 112 causes the layers of multi-layer wall 110 to begin to separate or delaminate from each other. Another example of a method of pre-delamination prior to filling is exposing multi-layer wall 110 to an atmosphere with high humidity. The high humidity reduces the adhesion between the layers of multi-layer wall 110 and can initiate delamination. Another example of pre-delamination prior to filling is shown in FIG. 8B. Here a negative pressure relative to the ambient atmosphere may be applied to interior volume 104 of bottle 100. In FIG. 8B, for example, the negative pressure is represented by cap 107 that has been modified to accept a hose 205 through which air is drawn out from interior volume 104. This negative pressure causes initial delamination of multi-layer wall 110 and improves successful delamination during filling of bottle 100 by reducing the force needed to fully delaminate the layers of multi-layer wall 110. Alternatively, a positive pressure may be applied to interior volume 104 prior to filling through hose 205. This positive pressure induces radial stress on the layers of multi-layer wall 110 that helps separate the layers before filling, thereby improving delamination. Many existing bottle filling lines already include fittings and/or caps 107 that are configured to attach to threads 105 of bottle 100 and that are able to apply positive or negative pressures during the filling process. Thus, this pre-delamination step can be applied while bottle 100 is on a filling line prior to filling.

Figure 8C:
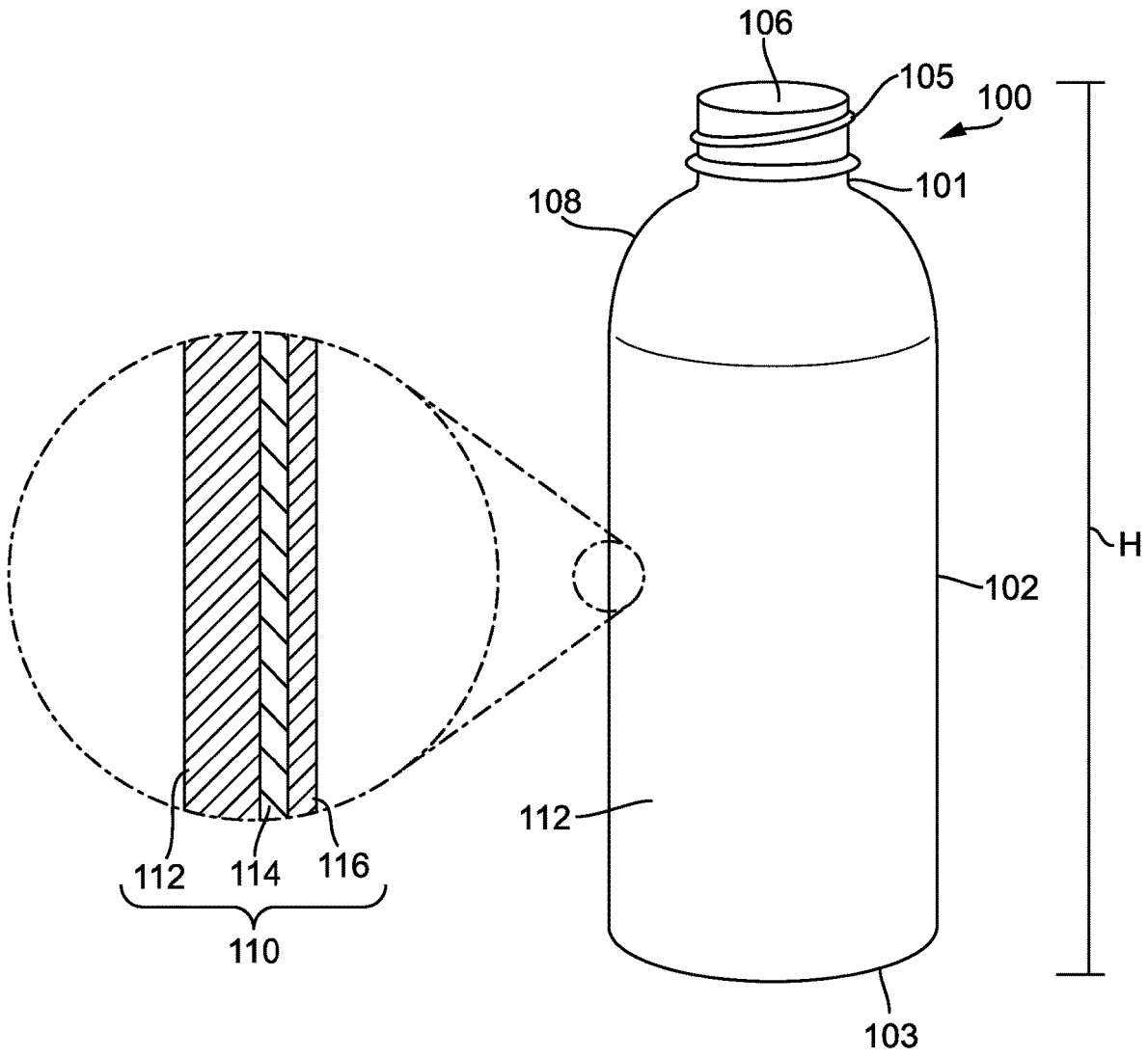
Figure 8D:
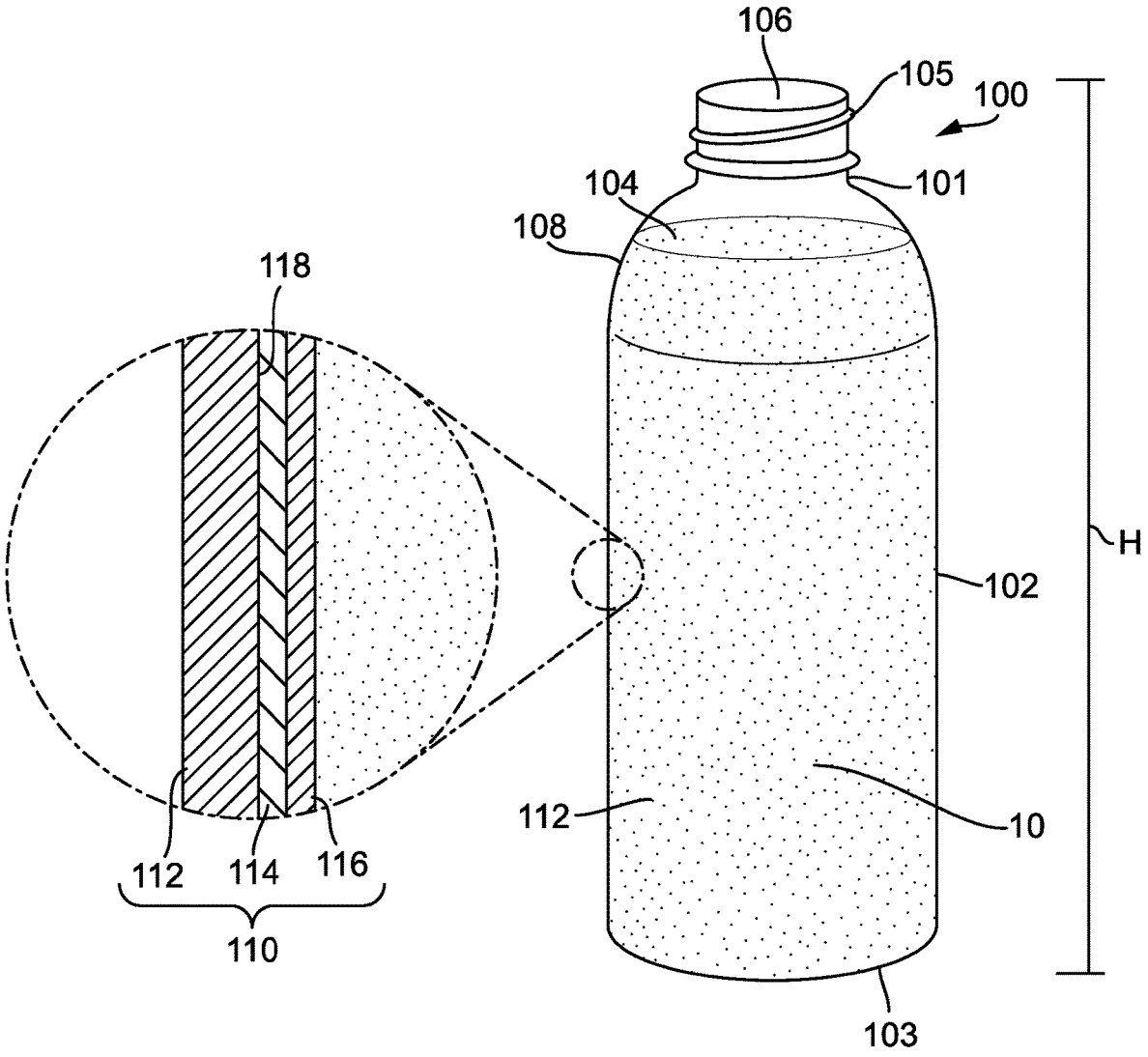

FIG. 8C shows bottle 100 after the pre-delamination step discussed with respect to FIG. 8B has been completed. In FIG. 8C, the layers of multi-layer wall 110 are back in contact with each other after the pre-delamination step has been completed. However, it should be understood that the pre-delamination step discussed above may result in the formation of space 118 through at least part of bottle 100. Middle layer 114 and inner layer 116 may therefore only approximately follow the shape of outer layer 112 because of the pre-delamination process. FIG. 8D shows bottle 100 filled with hot beverage 10 prior to sealing. As shown in the inset, the layers of multi-layer wall 110 are still in contact at this point because hot beverage 10 has not been sealed into bottle 100 and allowed to cool.

Figure 8E:
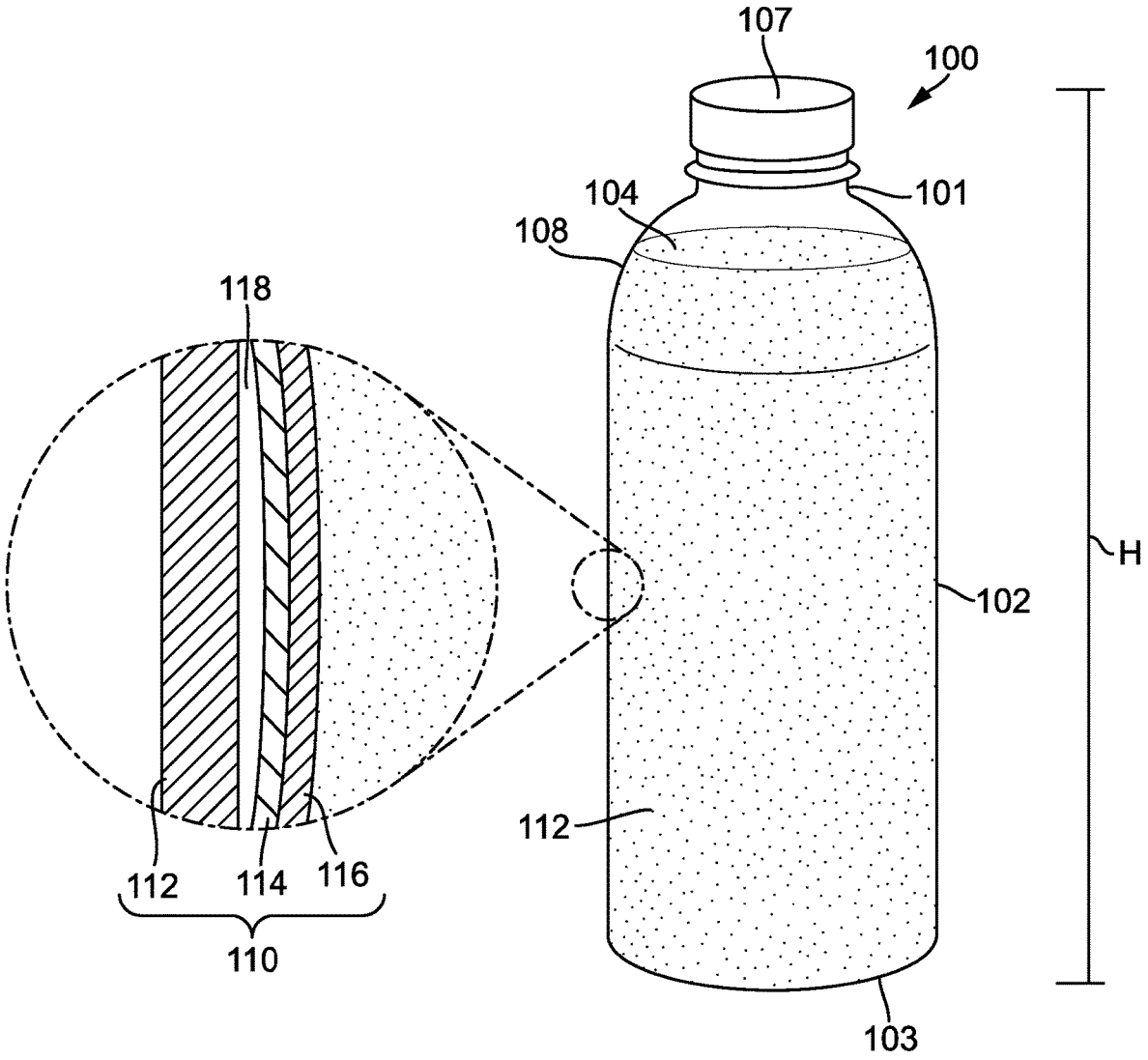

After filling of bottle 100, cap 107 is secured on thread 105 as shown in FIG. 8E. Hot beverage 10 then cools and, consequently, interior volume 104 contracts. The resulting negative pressure in interior volume 104 causes middle layer 114 and inner layer 116 to delaminate from outer layer 112 and flex inward to compensate for the reduced interior volume 104. Outer layer 112 does not flex inward and retains its designed outer shape after beverage 10 has cooled because of the contraction of middle layer 114 and inner layer 116. Space 118 is formed between outer layer 112 and middle layer 114 by the inward contraction of middle layer 114 and inner layer 116. Venting of space 118 to equalize with the ambient atmosphere is accomplished through one or more vent holes 120.

The breadth and scope of the present disclosure should not be limited by any of the above-described exemplary embodiments, but should be defined only in accordance with the claims and their equivalents.

What is claimed is:

1. A beverage bottle, comprising:

a body; and a neck disposed at one end of the body;

wherein the body is formed from a layered wall, the layered wall comprising:

an outer layer;

an inner layer;

an intermediate layer, wherein the outer layer and the inner layer are formed of the same material; and a vent hole formed in the body and disposed in the outer layer that allows a space to form between the outer layer and the intermediate layer to equalize with ambient pressure, the vent hole disposed in a bottom third of the beverage bottle, wherein the intermediate layer is a barrier layer, and wherein a thickness of the outer layer is between 2 and 5 times a thickness of the inner layer.

2. The beverage bottle of claim 1, wherein the intermediate layer comprises a different material than the outer layer and the inner layer.

3. The beverage bottle of claim 2, wherein the outer layer and the inner layer comprise PET.

4. The beverage bottle of claim 1, wherein the outer layer is thicker than the inner layer from a shoulder of the bottle to a base of the bottle.

5. The beverage bottle of claim 1, wherein a thickness of the intermediate layer is between 0.25 and 0.75 times the thickness of the inner layer.

6. The beverage bottle of claim 1, wherein the vent hole has a minimum opening dimension of 2 mm.

7. The beverage bottle of claim 1, wherein the vent hole has an elliptical shape.

8. The beverage bottle of claim 1, further comprising a plurality of vent holes in the outer layer, wherein the vent holes are spaced evenly around a circumference of the beverage bottle.

9. The beverage bottle of claim 1, wherein the intermediate layer does not extend into a base or a neck of the bottle.

10. The beverage bottle of claim 1, wherein the outer layer is formed with a smooth outer surface.

11. The beverage bottle of claim 1, further comprising:

a horizontal rib disposed around a circumference of a body of the beverage bottle, wherein the rib is a thickened section of the layered wall.

12. The beverage bottle of claim 1, further comprising a stress concentrator formed in the layered wall, wherein the stress concentrator is configured to concentrate a stress in the layered wall, wherein the vent hole is disposed adjacent to the stress concentrator.

13. A preform for a beverage bottle, comprising:

a layered wall, the layered wall comprising:

an outer layer;

an inner layer;

an intermediate layer, wherein the outer layer and the inner layer are formed of the same material; and a stress concentrator formed in at least the outer layer of the layered wall, wherein the stress concentrator is configured to concentrate a stress in the layered wall, and wherein the stress concentrator is formed as a circumferential indentation in the layered wall disposed near a base of the bottle, wherein the intermediate layer is a barrier layer, and wherein the outer layer is thicker than the inner layer.

14. The preform of claim 13, wherein the intermediate layer comprises a different material than the outer layer and the inner layer.

15. The preform of claim 13, wherein the outer layer and the inner layer comprise PET.

16. The preform of claim 13, wherein a thickness of the outer layer is between 2 and 5 times a thickness of the inner layer.

17. The preform of claim 13, wherein a thickness of the intermediate layer is between 0.1 and 0.35 times the thickness of the inner layer.

18. The preform of claim 13, further comprising a vent hole in the outer layer that allows a space to form between the outer layer and the intermediate layer to equalize with ambient pressure, the vent hole disposed in a bottom third of the beverage bottle, wherein the vent hole is disposed adjacent to the stress concentrator.

19. A beverage bottle, comprising:

a body; and a neck disposed at one end of the body;

wherein the body is formed from a layered wall, the layered wall comprising:

an outer layer;

an inner layer;

an intermediate layer, wherein the outer layer and the inner layer are formed of the same material; and a vent hole formed in the body and disposed in the outer layer that allows a space to form between the outer layer and the intermediate layer to equalize with ambient pressure, the vent hole disposed in a bottom third of the beverage bottle, wherein the intermediate layer is a barrier layer, wherein the outer layer is thicker than the inner layer, and wherein the intermediate layer does not extend into a base or a neck of the bottle.

* * * * *